US011572797B2

(12) United States Patent
Ono et al.

(10) Patent No.: US 11,572,797 B2
(45) Date of Patent: Feb. 7, 2023

(54) TURBINE ROTOR AND AXIAL FLOW TURBINE

(71) Applicant: TOSHIBA ENERGY SYSTEMS & SOLUTIONS CORPORATION, Kawasaki (JP)

(72) Inventors: Takahiro Ono, Ota Tokyo (JP); Tsuguhisa Tashima, Yokohama Kanagawa (JP); Shogo Iwai, Ota Tokyo (JP); Masao Itoh, Yokohama Kanagawa (JP)

(73) Assignee: TOSHIBA ENERGY SYSTEMS & SOLUTIONS CORPORATION, Kawasaki (JP)

( * ) Notice: Subject to any disclaimer, the term of this patent is extended or adjusted under 35 U.S.C. 154(b) by 37 days.

(21) Appl. No.: 17/347,104

(22) Filed: Jun. 14, 2021

(65) Prior Publication Data

US 2021/0396145 A1 Dec. 23, 2021

(30) Foreign Application Priority Data

Jun. 22, 2020 (JP) ..... JP2020-106969

(51) Int. Cl.
*F01D 9/06* (2006.01)

(52) U.S. Cl.
CPC ..... *F01D 9/065* (2013.01); *F05D 2220/30* (2013.01); *F05D 2240/12* (2013.01); *F05D 2260/202* (2013.01)

(58) Field of Classification Search
CPC ... F01D 5/085; F01D 5/06; F01D 5/08; F01D 5/081; F01D 9/065; F01D 5/087; F05D 2260/202; F05D 2240/12; F05D 2220/30
See application file for complete search history.

(56) References Cited

U.S. PATENT DOCUMENTS 6,053,701 A * 4/2000 Ichiryu ..... F01D 5/085 415/115
6,094,905 A 8/2000 Fukuyama
(Continued)

FOREIGN PATENT DOCUMENTS

DE 11 2015 003 934 T5 5/2017
EP 0 900 919 A2 3/1999
(Continued)

*Primary Examiner* — Courtney D Heinle
*Assistant Examiner* — Andrew Thanh Bui
(74) *Attorney, Agent, or Firm* — Foley & Lardner LLP

(57) ABSTRACT

A turbine rotor in an embodiment includes: a rotor body portion; and a plurality of turbine disks provided on the rotor body portion in a center axis direction of the rotor body portion. The turbine rotor includes: a high-pressure cooling passage formed in the rotor body portion, the high-pressure cooling passage to which a high-pressure cooling medium is supplied, and the high-pressure cooling passage that discharges the high-pressure cooling medium to the high-pressure side turbine stage; and a low-pressure cooling passage formed in the rotor body portion, the low-pressure cooling passage to which a low-pressure cooling medium whose pressure is lower than the pressure of the high-pressure cooling medium is supplied, and the low-pressure cooling passage that discharges the low-pressure cooling medium to the low-pressure side turbine stage.

9 Claims, 9 Drawing Sheets

(56) References Cited

U.S. PATENT DOCUMENTS

| | | | | |
|---|---|---|---|---|
| 7,017,349 | B2 | 3/2006 | Laurello et al. | |
| 10,550,698 | B2 | 2/2020 | Inomata et al. | |
| 10,746,028 | B2 * | 8/2020 | Kim | F01D 5/187 |
| 2001/0006601 | A1 * | 7/2001 | Wilson | F01D 5/085<br>416/95 |
| 2013/0111921 | A1 * | 5/2013 | Rajesh | F01D 5/08<br>60/785 |
| 2014/0056686 | A1 * | 2/2014 | Zhang | F01D 5/081<br>415/1 |
| 2016/0376890 | A1 | 12/2016 | Inomata et al. | |
| 2017/0234135 | A1 | 8/2017 | Takamura et al. | |
| 2019/0323351 | A1 | 10/2019 | Tsuruta et al. | |

FOREIGN PATENT DOCUMENTS

| | | | |
|---|---|---|---|
| JP | 2004-239254 | A | 8/2004 |
| JP | 2005-320875 | A | 11/2005 |
| JP | 2013-019284 | A | 1/2013 |
| WO | WO-2016/143103 | A1 | 9/2016 |

* cited by examiner

TURBINE ROTOR AND AXIAL FLOW TURBINE

CROSS REFERENCE TO RELATED APPLICATIONS

This application is based upon and claims the benefit of priority from Japanese Patent Application No. 2020-106969, filed on Jun. 22, 2020; the entire contents of which are incorporated herein by reference.

FIELD

Embodiments described herein relate generally to a turbine rotor and an axial flow turbine.

BACKGROUND

In recent years, the performance of a turbine has been improved in order to improve the efficiency of the turbine in power plants. In order to improve the performance of the turbine, the inlet temperature of the turbine tends to be increased.

With such an increase in the inlet temperature of the turbine, it is necessary to use the materials forming components of the turbine under a proper temperature. Therefore, the components of the turbine such as a turbine rotor, rotor blades, and stator blades are cooled by introducing a cooling medium.

FIG. 14 is a view illustrating a meridian cross section of a conventional axial flow turbine 300. FIG. 14 illustrates a turbine structure of a gas turbine.

As illustrated in FIG. 14, the conventional axial flow turbine 300 includes an outer casing 310 and an inner casing 311 provided inside the outer casing 310. Further, a turbine rotor 340 is provided through the inner casing 311 and the outer casing 310.

An outer shroud 320 is provided on an inner periphery of the inner casing 311 over the circumferential direction. An inner shroud 321 is provided at the inner side of this outer shroud 320 over the circumferential direction. Then, between the outer shroud 320 and the inner shroud 321, a plurality of stator blades 322 are supported in the circumferential direction to form a stator blade cascade.

Here, the circumferential direction is the circumferential direction centered on a center axis O of the turbine rotor, that is, the direction around the center axis O.

A heat shield piece 325 is provided at the inner side of the inner shroud 321 over the circumferential direction in a manner to face the inner shroud 321. A sealing part is formed between the inner shroud 321 and the heat shield piece 325. Further, the heat shield piece 325 is implanted in the turbine rotor 340.

The turbine rotor 340 includes a turbine disk 341 projecting to a radially outer side over the circumferential direction. The turbine disk 341 is provided in a plurality of stages in the center axis direction of the turbine rotor 340. Then, a plurality of rotor blades 350 are implanted in the circumferential direction on each of the turbine disks 341 to form a rotor blade cascade.

The center axis direction of the turbine rotor is simply referred to as an axial direction below. The radially outer side is the side that is going away from the center axis O in the radial direction. The radial direction is the direction vertical to the center axis O, with the center axis O set as a base point.

The stator blade cascade and the rotor blade cascade are provided alternately in the axial direction of the turbine rotor. Then, the stator blade cascade and the rotor blade cascade immediately downstream from the stator blade cascade form a turbine stage. Here, a plurality of turbine stages are provided in the axial direction. Thereby, a working fluid flow path 312 through which a working fluid flows is formed in the axial direction between the inner casing 311 and the turbine rotor 340. The term downstream means a downstream side with respect to the main flow direction of the working fluid.

As illustrated in FIG. 14, a transition piece 360, which leads a combustion gas (working fluid) discharged from a combustor (not illustrated) to the first-stage stator blades 322, is provided through the outer casing 310 and the inner casing 311.

Further, in the conventional axial flow turbine 300, a cooling medium is introduced in order to cool the turbine rotor 340.

An axial passage 370, through which the cooling medium flows in the axial direction, is formed in the center of the turbine rotor 340. The axial passage 370 is extended in the axial direction with the center axis O of the turbine rotor 340 set as the center axis, as illustrated in FIG. 14.

Further, in the turbine rotor 340, there is provided an introduction passage 371 that leads the cooling medium supplied into a space 361 in the inner casing 311 from around the transition piece 360 through a cooling medium supply pipe 362 to the axial passage 370. The introduction passage 371 is formed in the radial direction to be communicated with the axial passage 370.

Further, in the turbine rotor 340, there is provided a discharge passage 372 that discharges the cooling medium flowing through the axial passage 370 into a space 363 between the heat shield piece 325 and the turbine rotor 340. The discharge passage 372 is formed in the radial direction and is communicated with the axial passage 370. A plurality of the discharge passages 372 are provided in the axial direction so as to enable the cooling medium to be discharged into the space 363 in each of the turbine stages.

Here, the cooling medium supplied into the space 361 from the cooling medium supply pipe 362 is led to the axial passage 370 through the introduction passage 371. Then, the cooling medium flowing through the axial passage 370 is discharged into the space 363 through the discharge passage 372.

On this occasion, the pressures of the cooling mediums discharged from the discharge passages 372 in the respective turbine stages are essentially the same if the pressure loss in flowing through the axial passage 370 is ignored. That is, in each of the turbine stages, the cooling medium of the same pressure is ejected from the discharge passage 372 into the space 363 communicating with the working fluid flow path 312.

Here, in order to improve the efficiency of the turbine, there has been studied a gas turbine facility in which a part of a working fluid discharged from a turbine is circulated through a combustor and the turbine as a cooling medium. In this gas turbine facility, a supercritical working fluid is circulated through the combustor and the turbine. Further, in the turbine of this gas turbine facility, the working fluid at an inlet of the turbine is a supercritical fluid.

The turbine into which the supercritical working fluid is to be introduced has a pressure ratio larger than that in a normal gas turbine. The pressure ratio is the ratio of the pressure of the working fluid at the inlet of the turbine to the pressure of the working fluid in an exhaust hood downstream of the final turbine stage.

Even in the gas turbine facility that uses such a supercritical working fluid, the axial flow turbine 300 including the above-described cooling structure is provided in order to use the materials forming the components of the turbine under a proper temperature.

When the axial flow turbine 300 including the above-described cooling structure is operated with the supercritical working fluid, the pressure of the cooling medium supplied into the space 361 is adjusted to be higher than that of the working fluid introduced into the turbine. That is, the pressure of the cooling medium led to the axial passage 370 through the introduction passage 371 is higher than that of the working fluid introduced into the turbine.

Then, the cooling medium whose pressure is higher than that of the working fluid is ejected from the discharge passage 372 into the space 363 communicating with the working fluid flow path 312 in each of the turbine stages.

In the axial flow turbine 300, the difference between the pressure of the working fluid flowing through the working fluid flow path 312 and the pressure of the cooling medium ejected from the discharge passage 372 increases as it goes to the downstream turbine stage. Then, since the axial flow turbine 300 has a high pressure ratio, the pressure of the working fluid in the downstream turbine stage is much lower than that of the working fluid in the upstream turbine stage.

Therefore, in the downstream turbine stage, the difference between the pressure of the cooling medium discharged from the discharge passage 372 and the pressure of the working fluid flowing through the working fluid flow path 312 is large, so that the flow of the cooling medium ejected from the discharge passage 372 becomes choked.

This makes it difficult to adjust the flow rate of the cooling medium to be ejected from the discharge passage 372 in the downstream turbine stage where the flow of the cooling medium becomes choked.

DETAILED DESCRIPTION

Hereinafter, there will be explained embodiments of the present invention with reference to the drawings.

In one embodiment, a turbine rotor includes: a column-shaped rotor body portion; and a plurality of turbine disks projecting to a radially outer side from an outer peripheral surface of the rotor body portion over a circumferential direction and provided in a center axis direction of the rotor body portion to form a plurality of turbine stages.

The turbine rotor includes: a first cooling passage portion formed in the rotor body portion, the first cooling passage portion to which a first cooling medium is supplied, and the first cooling passage portion that discharges the first cooling medium to the high-pressure side turbine stage, which is the high-pressure side out of the turbine stages; and a second cooling passage portion formed in the rotor body portion, the second cooling passage portion to which a second cooling medium whose pressure is lower than the pressure of the first cooling medium is supplied, and the second cooling passage portion that discharges the second cooling medium to the low-pressure side turbine stage, which is the side lower in pressure than the high-pressure side turbine stage.

First Embodiment

Figure 1:
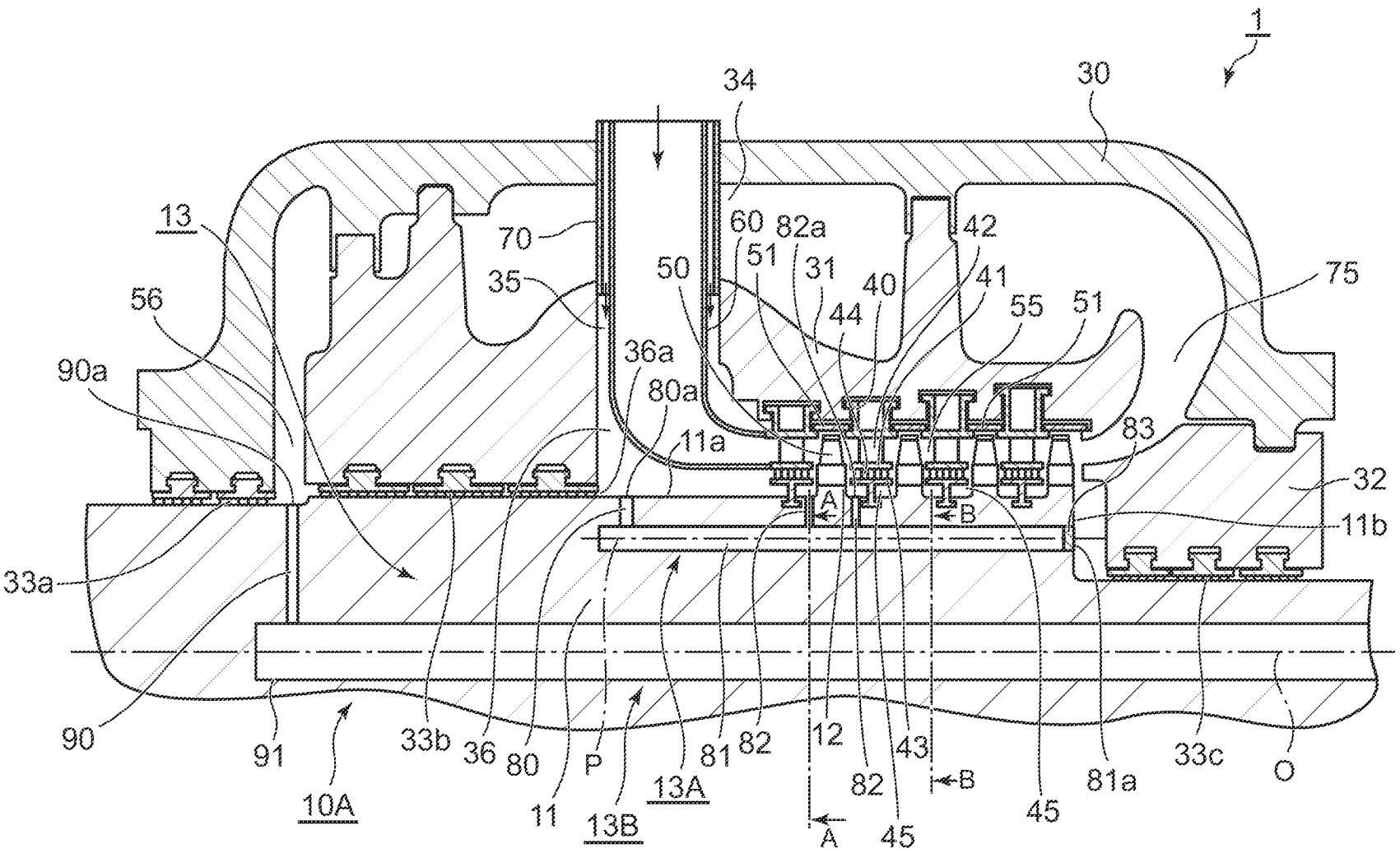
FIG. 1 is a view illustrating a meridian cross section of an axial flow turbine including a turbine rotor in a first embodiment.

FIG. 1 is a view illustrating a meridian cross section of an axial flow turbine 1 including a turbine rotor 10A in a first embodiment. FIG. 1 illustrates a gas turbine structure in which a supercritical working fluid is introduced into a turbine.

As illustrated in FIG. 1, the axial flow turbine 1 includes an outer casing 30 and an inner casing 31 provided inside the outer casing 30. Further, the turbine rotor 10A is provided through the inner casing 31 and the outer casing 30.

An outer shroud 40 is provided on an inner periphery of the inner casing 31 over the circumferential direction. An inner shroud 41 is provided at the inner side of this outer shroud 40 (a radially inner side) over the circumferential direction. Then, between the outer shroud 40 and the inner shroud 41, a plurality of stator blades 42 are supported in the circumferential direction to form a stator blade cascade. This stator blade cascade is provided in a plurality of stages in the axial direction (the direction of a center axis O of the turbine rotor 10A).

Here, the radially inner side is the side that approaches the center axis O in the radial direction (the center axis O side).

At the inner side of the inner shroud 41, a heat shield piece 43 is provided over the circumferential direction in a manner to face the inner shroud 41. The heat shield piece 43 is implanted in the turbine rotor 10A, for example. A sealing part 44 is formed between the inner shroud 41 and the heat shield piece 43.

The turbine rotor 10 includes a rotor body portion 11, turbine disks 12, and a cooling structure part 13.

The rotor body portion 11 is formed of a column-shaped member. Both ends of the rotor body portion 11 are rotatably supported by bearings (not illustrated). The center axis of the rotor body portion 11 is the same as the center axis O of the turbine rotor 10A. Therefore, the center axis direction of the rotor body portion 11 is the same as the center axis direction of the turbine rotor 10A, which is referred to as the axial direction.

The turbine disk 12 projects to a radially outer side from an outer peripheral surface of the rotor body portion 11 over the circumferential direction. This turbine disk 12, which is formed of an annular projecting body, is provided in a plurality of stages in the axial direction to form a plurality of turbine stages. Here, the radially outer side is the side that is going away from the center axis O in the radial direction.

In a tip portion of each of the turbine disks 12, a plurality of rotor blades 50 are implanted in the circumferential direction to form a rotor blade cascade. An outer periphery of the rotor blades 50 is surrounded by a shroud segment 51, for example. The shroud segment 51 is supported by the outer shroud 40.

The stator blade cascade and the rotor blade cascade are provided alternately in the axial direction. Then, the stator blade cascade and the rotor blade cascade immediately downstream from the stator blade cascade form a turbine stage. A working fluid flow path 55 through which the working fluid flows is formed by a plurality of the turbine stages.

As illustrated in FIG. 1, a gland sealing part 33*a* is provided between the turbine rotor 10A and the outer casing 30. A gland sealing part 33*b* is provided between the turbine rotor 10A and the inner casing 31. A gland sealing part 33*c* is provided between the turbine rotor 10A and a packing head 32. These gland sealing parts 33*a*, 33*b*, and 33*c* inhibit the leakage of a working fluid and a cooling medium to the outside.

The gland sealing part 33*b* and the gland sealing part 33*a* are provided on the introduction side of the working fluid and the cooling medium, and function as a high-pressure side gland sealing part. In the meantime, the gland sealing part 33*c* is provided on the exhaust hood 75 side, and functions as a low-pressure side gland sealing part.

Further, at the high-pressure side gland sealing part, as illustrated in FIG. 1, a space 56 is formed between the gland sealing part 33*b* and the gland sealing part 33*a*. In other words, there is a gap in the axial direction between the inner casing 31 supporting the gland sealing part 33*b* and the outer casing 30 supporting the gland sealing part 33*a*.

Then, the space 56 enclosed with the inner casing 31, the outer casing 30, the turbine rotor 10A, and the gland sealing parts 33*a*, 33*b* is formed by this gap. The space 56 functions as a space formed at the high-pressure side gland sealing part here.

The turbine rotor 10A includes the cooling structure part 13 that cools the turbine rotor 10A by the cooling medium. This cooling structure part 13 includes a high-pressure cooling passage 13A and a low-pressure cooling passage 13B. The structure of this cooling structure part 13 will be explained in detail later.

Here, the turbine rotor 10A is preferably formed of, for example, a mono-block rotor integrally forming the entire turbine rotor 10A, in consideration of the forming process of the cooling structure part 13, and so on. In this case, the turbine rotor 10A is an integrated forged product.

The turbine rotor 10A can also be formed of a joined rotor formed by joining a plurality of turbine rotor component members, for example. In this case, the portion including the cooling structure part 13 is preferably formed of a single turbine rotor component member in consideration of the forming process of the cooling structure part 13, and so on. The joined rotor is formed by joining the turbine rotor component members by, for example, welding, friction welding, or the like, in the axial direction.

Here, the axial flow turbine 1 includes a transition piece 60 through the outer casing 30 and the inner casing 31. A downstream end of the transition piece 60 is in contact with upstream ends of the inner shroud 41 and the outer shroud 40 supporting the first-stage stator blades 42. Then, the transition piece 60 leads a combustion gas (working fluid) discharged from a combustor (not illustrated) to the first-stage stator blades 42.

In a penetration region where the transition piece 60 penetrates the outer casing 30 and the inner casing 31, an outer periphery of the transition piece 60 is surrounded with a cooling medium supply pipe 70 into which the cooling medium is to be introduced. That is, in the penetration region, a double-pipe structure formed by the transition piece 60 and the cooling medium supply pipe 70 provided around the outer periphery side of the transition piece 60 is provided.

In order to prevent the cooling medium flowing through an annular passage between the transition piece 60 and the cooling medium supply pipe 70 from flowing into a space 34 between the outer casing 30 and the inner casing 31, a downstream end of the cooling medium supply pipe 70 extends into a through opening 35 formed in the inner casing 31. The through opening 35 is an opening for allowing the transition piece 60 and the cooling medium supply pipe 70 to penetrate into the inner casing 31.

An outlet of the cooling medium supply pipe 70 is communicated with a space 36 in the inner casing 31 into which the transition piece 60 is inserted. That is, the cooling medium introduced from the cooling medium supply pipe 70 flows into the space 36.

The temperature of the cooling medium flowing into the space 36 is sufficiently lower than that of the working fluid introduced into the first-stage stator blades 42. That is, the temperature of the cooling medium flowing into the space 36 is the temperature to function as the cooling medium for cooling the turbine rotor 10A, and the like.

Here, the configuration to supply the cooling medium into the space 36 is not limited to this configuration. That is, the cooling medium supply pipe 70 is not limited to the configuration provided around the transition piece 60. The cooling medium supply pipe 70 only needs to be configured to be capable of supplying the cooling medium into the space 36 through the outer casing 30 and the inner casing 31, for example.

As described above, the axial flow turbine 1 is a unidirectional flow turbine in which the working fluid ejected from the transition piece 60 flows in one direction.

Next, the cooling structure part 13 of the turbine rotor 10A is explained in detail.

Figure 2:
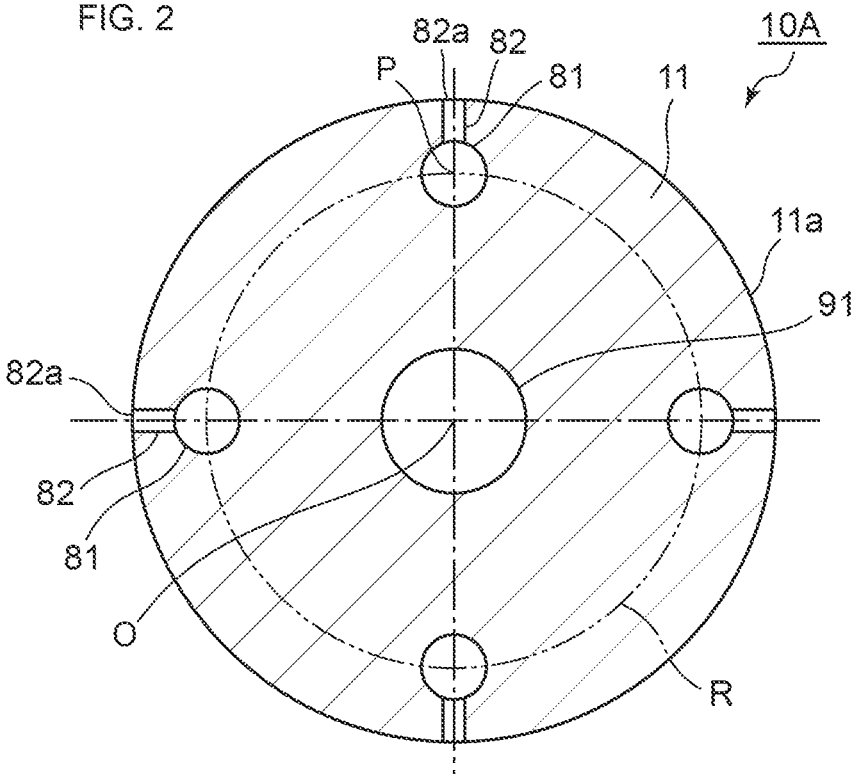
FIG. 2 is a view illustrating a cross section taken along A-A in FIG. 1.
Figure 3:
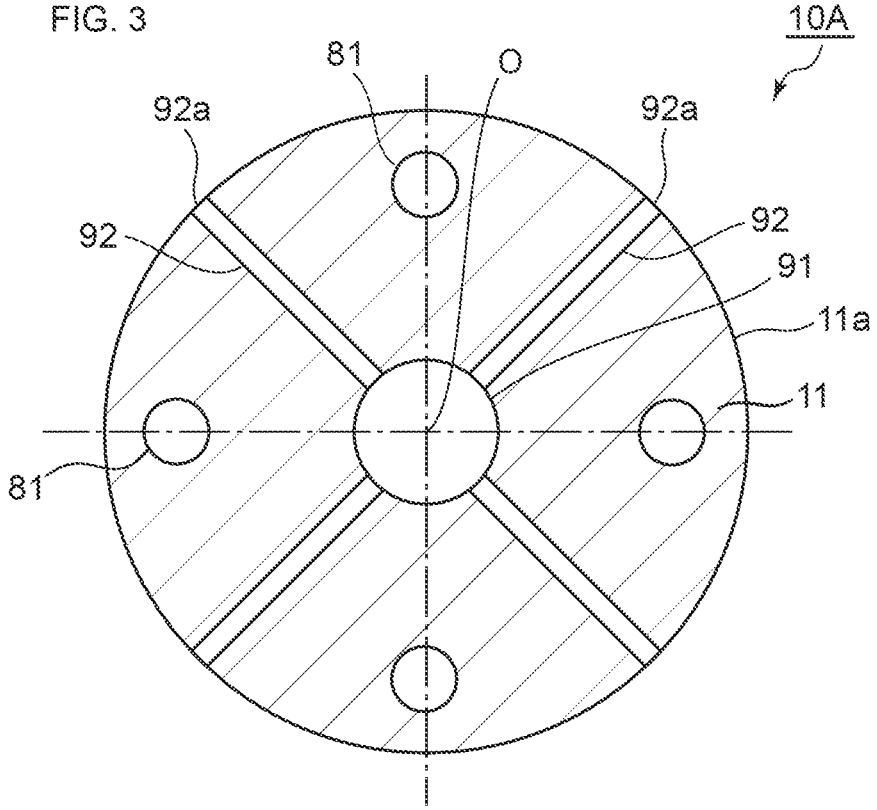
FIG. 3 is a view illustrating a cross section taken along B-B in FIG. 1.

FIG. 2 is a view illustrating a cross section taken along A-A in FIG. 1. FIG. 3 is a view illustrating a cross section taken along B-B in FIG. 1. FIG. 2 and FIG. 3 each illustrate a cross section vertical to the center axis O of the turbine rotor 10A. Here, the explanation is made with reference to FIG. 1, FIG. 2, and FIG. 3.

The cooling structure part 13 is formed in the rotor body portion 11 in the turbine rotor 10A. Further, as described previously, the cooling structure part 13 includes the high-pressure cooling passage 13A and the low-pressure cooling passage 13B.

First, the high-pressure cooling passage 13A is explained.

The supercritical cooling medium introduced into the space 36 from the cooling medium supply pipe 70 is introduced into the high-pressure cooling passage 13A. The cooling medium to be introduced into the high-pressure cooling passage 13A from the space 36 is referred to as a high-pressure cooling medium here.

Further, the high-pressure cooling passage 13A discharges the high-pressure cooling medium to the high-pressure side turbine stage, which is the high-pressure side out of a plurality of the turbine stages. The high-pressure cooling passage 13A functions as a first cooling passage portion. Further, the high-pressure cooling medium functions as a first cooling medium.

Here, the pressure of the high-pressure cooling medium to be discharged from the high-pressure cooling passage 13A is higher than that of the working fluid to flow through the high-pressure side turbine stage.

The high-pressure side turbine stage consists of, for example, the first turbine stage or the first turbine stage and several turbine stages downstream from the first stage. The high-pressure side turbine stage consists of a turbine stage where the high-pressure cooling medium does not become a choked flow when the high-pressure cooling medium is to be ejected to the turbine stage.

In one example illustrated in FIG. 1, out of the four turbine stages, the two upstream stages are set as the high-pressure side turbine stage. The constitution of the high-pressure side turbine stages is not limited to this. As described above, any turbine stage where the high-pressure cooling medium does not become a choked flow when the high-pressure cooling medium is to be ejected to the turbine stage may be constituted as the high-pressure side turbine stage.

As illustrated in FIG. 1, the high-pressure cooling passage 13A includes an introduction passage 80, an axial passage 81, and discharge passages 82. The introduction passage 80, the axial passage 81, and the discharge passages 82 are communicated with one another. Here, the introduction passage 80 functions as a first introduction passage, the axial passage 81 functions as a first axial passage, and the discharge passage 82 functions as a first discharge passage.

The introduction passage 80 is formed of, for example, a through hole penetrating from an outer peripheral surface 11*a* of the rotor body portion 11 into the axial passage 81. The introduction passage 80 is formed, for example, in the radial direction.

The introduction passage 80 may be formed to have an inclination in the axial direction with respect to the radial direction. Further, the introduction passage 80 may be formed to have an inclination in the circumferential direction with respect to the radial direction.

An inlet 80*a* of the introduction passage 80 opens in the space 36 in the inner casing 31 into which the supercritical cooling medium is to be introduced. That is, the space 36 and the axial passage 81 are communicated through the introduction passage 80.

A plurality of the introduction passages 80 may be provided in the axial direction, for example. In this case, the supercritical cooling medium introduced into the space 36 flows into the axial passage 81 through a plurality of the introduction passages 80.

As illustrated in FIG. 1 and FIG. 2, the axial passage 81 is formed in the axial direction in the rotor body portion 11, on the radially outer side relative to the center axis O of the turbine rotor 10A and on the radially inner side relative to the outer peripheral surface 11*a* of the rotor body portion 11. That is, the axial passage 81 is formed between the center axis O and the outer peripheral surface 11*a* of the rotor body portion 11. Further, the center axis O is not included in the axial passage 81. The axial passage 81 is formed of, for example, a hole with a circular cross section.

The axial passage 81 is formed in the center axis direction of the turbine rotor 10A. The axial passage 81 is formed parallel to the center axis O of the turbine rotor 10A, as illustrated in FIG. 1, for example.

A plurality of the axial passages 81 are provided, for example. In this case, the plural axial passages 81 having the same shape are provided. Then, as illustrated in FIG. 2, the axial passages 81 are evenly arranged on the same circumference R around the center axis O. In other words, in the cross section illustrated in FIG. 2, center axes P of the respective axial passages 81 are located on the same circumference R around the center axis O, and lengths in the circumferential direction between the center axes P of the axial passages 81 are equal to each other.

Further, the axial passage 81 is formed, for example, from the position in the axial direction where the introduction passage 80 is formed to the position in the axial direction corresponding to the outlet of the final turbine stage, as illustrated in FIG. 1.

Here, the axial passage 81 is formed to penetrate from the position in the axial direction corresponding to an upstream end 36*a* of the space 36 to a downstream end 11*b* where the diameter of the turbine rotor is small, which faces the packing head 32. In this case, an outlet 81*a* of the axial passage 81 is sealed by a sealing member 83.

The range in the axial direction where the axial passage 81 is formed is not limited to this. The axial passage 81 only needs to be formed within a range where the high-pressure cooling medium is introduced from the introduction passage 80 and the high-pressure cooling medium is led to the respective discharge passages 82.

The discharge passages 82 are formed in a manner to correspond to the high-pressure side turbine stages as illustrated in FIG. 1. Here, the discharge passages 82 are formed at the positions in the axial direction corresponding to the first turbine stage and the second turbine stage.

The discharge passage 82 is formed of a through hole penetrating from the axial passage 81 into the outer peripheral surface 11*a* of the rotor body portion 11. Specifically, as illustrated in FIG. 1, the discharge passage 82 communicates the axial passage 81 with a space 45 between the heat shield piece 43 and the outer peripheral surface 11*a*.

Here, the space 45 communicates with the working fluid flow path 55 through a gap between the inner shroud 41 and the heat shield piece 43 and the turbine disk 12.

The discharge passages 82 have an outlet 82*a* in the outer peripheral surface 11*a* of the rotor body portion 11 on the upstream side of the first-stage turbine disk 12 and an outlet 82*a* in the outer peripheral surface 11*a* of the rotor body portion 11 between the first-state turbine disk 12 and the second-stage turbine disk 12.

For example, in the first turbine stage, the outlet 82*a* of the discharge passage 82 opens in the space 45 enclosed with the heat shield piece 43, the outer peripheral surface 11*a*, and the first-stage turbine disk 12.

In the second turbine stage, the outlet 82*a* of the discharge passage 82 opens in the space 45 enclosed with the upstream-side and downstream-side turbine disks 12, the heat shield piece 43, and the outer peripheral surface 11*a*.

Note that there is illustrated one example in which the outlet 82*a* of the discharge passage 82 is located on the upstream turbine disk 12 side in the second and subsequent turbine stages. In the second and subsequent turbine stages, the outlet 82*a* of the discharge passage 82 may be located on the downstream turbine disk 12 side.

The discharge passage 82 is formed, for example, in the radial direction. The discharge passage 82 may be formed to have an inclination in the axial direction with respect to the radial direction. Further, the discharge passage 82 may be formed to have an inclination in the circumferential direction with respect to the radial direction.

Here, as illustrated in FIG. 2, the discharge passage 82 is formed at each of the axial passages 81. Further, the introduction passage 80 is also formed at each of the axial passages 81, similarly to the discharge passage 82, which is not illustrated.

Next, the low-pressure cooling passage 13B is explained.

The cooling medium that has flowed into the space 56 at the high-pressure side gland sealing part is introduced into the low-pressure cooling passage 13B. The cooling medium whose pressure is lower than that of the high-pressure cooling medium to be introduced into the high-pressure cooling passage 13A is introduced into the low-pressure cooling passage 13B. Here, the cooling medium whose pressure is lower than that of the high-pressure cooling medium, which is to be introduced into the low-pressure cooling passage 13B, is referred to as a low-pressure cooling medium. Further, the low-pressure cooling medium functions as a second cooling medium.

Further, the low-pressure cooling passage 13B discharges the low-pressure cooling medium to the low-pressure side turbine stage, which is the side lower in pressure than the high-pressure side turbine stage. The low-pressure cooling passage 13B functions as a second cooling passage portion.

Here, the pressure of the low-pressure cooling medium to be discharged from the low-pressure cooling passage 13B is higher than that of the working fluid to flow in the low-pressure side turbine stage.

The low-pressure side turbine stage consists of the turbine stage downstream from the high-pressure side turbine stages described above. In one example illustrated in FIG. 1, the two downstream-side stages out of the four turbine stages are set as the low-pressure side turbine stages. The pressure of the working fluid flowing in the low-pressure side turbine stages is lower than that of the working fluid flowing in the high-pressure side turbine stages.

As illustrated in FIG. 1 and FIG. 3, the low-pressure cooling passage 13B includes an introduction passage 90, an axial passage 91, and discharge passages 92. The introduction passage 90, the axial passage 91, and the discharge passages 92 are communicated with one another.

In the cross section illustrated in FIG. 1, the discharge passages 92 are not seen. That is, as illustrated in FIG. 3, the discharge passages 92 are each arranged at the position displaced in the circumferential direction around the center axis O with respect to the discharge passage 82 illustrated in FIG. 2. This makes it possible to prevent the discharge passage 92 from intersecting the axial passage 81 of the high-pressure cooling passage 13A.

Here, the introduction passage 90 functions as a second introduction passage, the axial passage 91 functions as a second axial passage, and the discharge passage 92 functions as a second discharge passage.

The introduction passage 90 is formed of, for example, a through hole penetrating from the outer peripheral surface 11*a* of the rotor body portion 11 into the axial passage 91. The introduction passage 90 is formed, for example, in the radial direction.

The introduction passage 90 may be formed to have an inclination in the axial direction with respect to the radial direction. Further, the introduction passage 90 may be formed to have an inclination in the circumferential direction with respect to the radial direction.

An inlet 90*a* of the introduction passage 90 opens in the space 56 at the high-pressure side gland sealing part. That is, the space 56 and the axial passage 91 are communicated through the introduction passage 90.

Here, the supercritical cooling medium that has passed through the gland sealing part 33*b* from the space 36 flows into the space 56. This supercritical cooling medium decreases in pressure as it passes through the gland sealing part 33*b*, and becomes the low-pressure cooling medium. The pressure of the low-pressure cooling medium in the space 56 is higher than that of the working fluid flowing in the low-pressure side turbine stage.

As illustrated in FIG. 1 and FIG. 3, the axial passage 91 is extended in the axial direction with the center axis O of the turbine rotor 10A set as the center axis. The axial passage 91 is formed of, for example, a hole with a circular cross section.

Further, as illustrated in FIG. 1, the axial passage 91 is formed, for example, from the position in the axial direction where the introduction passage 90 is formed to the position in the axial direction corresponding to at least the low-pressure side turbine stage.

FIG. 1 illustrates one example where the axial passage 91 penetrates from the position in the axial direction where the introduction passage 90 is formed to the low-pressure side. In this case, an outlet of the axial passage 91 is sealed by a sealing member (not illustrated). Further, the axial passage 91 only needs to be formed within a range where the low-pressure cooling medium is introduced from the introduction passage 90 and the cooling medium is led to the respective discharge passages 92.

The discharge passages 92 are formed in a manner to correspond to the low-pressure side turbine stages as illustrated in FIG. 1 and FIG. 3. Here, the discharge passages 92 are formed at the positions in the axial direction corresponding to the third turbine stage and the fourth turbine stage.

The discharge passage 92 is formed of a through hole penetrating from the axial passage 91 into the outer peripheral surface 11*a* of the rotor body portion 11. The discharge passage 92 has an outlet 92*a* in the outer peripheral surface 11*a* of the rotor body portion 11. Then, the outlet 92*a* opens in the space 45.

The axial flow turbine in this embodiment is a turbine into which a supercritical working fluid is to be introduced. As a facility including this axial flow turbine, a supercritical $CO_2$ gas turbine facility where a part of the working fluid discharged from the turbine is circulated through a combustor and the turbine as a cooling medium can be cited as an example. The cooling medium to be circulated in the supercritical $CO_2$ gas turbine facility is supercritical carbon dioxide.

Further, in the above-described axial flow turbine 1, there has been explained one example in which the heat shield piece 43 is provided at the inner side of the inner shroud 41, but the axial flow turbine 1 is not limited to this configuration.

For example, the heat shield piece 43 does not need to be provided at the inner side of the inner shroud 41. In this case, the sealing part is provided between the inner shroud 41 and the outer peripheral surface 11*a* of the rotor body portion 11. Then, the outlets 82*a*, 92*a* of the discharge passages 82, 92 are located at the outer peripheral surface 11*a* of the rotor body portion 11 of the portion forming the sealing part, for example.

Next, there are explained actions of the axial flow turbine 1 and the cooling structure part 13 of the turbine rotor 10A with reference to FIG. 1.

First, the action of the axial flow turbine 1 is explained.

The combustion gas (working fluid) discharged from the combustor (not illustrated) is introduced into the axial flow turbine 1 through the transition piece 60. The working fluid introduced into the axial flow turbine 1 is led to the first-stage stator blades 42. Then, the working fluid is ejected from the first-stage stator blades 42 toward the first-stage rotor blades 50.

In this manner, the working fluid flows through the working fluid flow path 55 including the stator blades 42 and the rotor blades 50 in the second and subsequent stages while performing expansion work to rotate the turbine rotor 10A. The combustion gas that has passed through the final-stage rotor blades 50 is discharged from the axial flow turbine 1 through an exhaust hood 75.

Next, the action of the cooling structure part 13 of the turbine rotor 10A is explained.

The supercritical cooling medium passes through the cooling medium supply pipe 70 to be led to the space 36 in the inner casing 31 into which the transition piece 60 is inserted. On this occasion, the cooling medium is led to the space 36 through the annular passage between the transition piece 60 and the cooling medium supply pipe 70. When this configuration is provided, it is possible to obtain the effect of cooling the transition piece 60 by the cooling medium.

Here, the outer peripheral surface 11*a* of the rotor body portion 11 is cooled by the cooling medium led to the space 36. The pressure of the cooling medium introduced into the space 36 is higher than that of the combustion gas ejected from the transition piece 60.

A part of the cooling medium led to the space 36 flows into the introduction passage 80 from the inlet 80*a*. The cooling medium that has flowed into the introduction passage 80 functions as the high-pressure cooling medium.

The high-pressure cooling medium that has flowed into the introduction passage 80 flows into the axial passage 81 through the introduction passage 80. The flow rate of the cooling medium led to the axial passage 81 is adjusted by a bore or the like of the introduction passage 80, for example.

The high-pressure cooling medium led to the axial passage 81 flows through the axial passage 81 toward the downstream side in the axial direction. The high-pressure cooling medium flowing through the axial passage 81 toward the downstream side in the axial direction flows into the respective discharge passages 82 formed to correspond to the high-pressure side turbine stages.

The high-pressure cooling medium that has flowed into the discharge passage 82 flows through the discharge passage 82 to be ejected from the outlet 82*a* into the space 45 in the high-pressure side turbine stage. The flow rate of the high-pressure cooling medium led to each of the discharge passages 82 is adjusted by a bore or the like of each of the discharge passages 82, for example.

Here, the rotor body portion 11 (the turbine rotor 10A) is cooled from the inside by the high-pressure cooling medium flowing through the introduction passage 80, the axial passage 81, and the discharge passages 82.

The high-pressure cooling medium that has spread in the space 45 flows into the working fluid flow path 55 through a gap between the heat shield piece 43 and the turbine disk 12 and a gap between the inner shroud 41 and the turbine disk 12. The high-pressure cooling medium that has flowed into the working fluid flow path 55 flows through the working fluid flow path 55 with the working fluid to be discharged into the exhaust hood 75.

Here, the outer peripheral surface 11*a* of the rotor body portion 11 facing the space 45 and the turbine disk 12 are cooled by the high-pressure cooling medium flowing into the space 45 and the high-pressure cooling medium flowing out into the working fluid flow path 55.

Further, a part of the cooling medium led to the space 36 flows into the outer shroud 40 and to the sealing part 44. Specifically, the cooling medium flows on the downstream side of the sealing part 44 between the inner shroud 41 and the heat shield piece 43. Further, the cooling medium is led into the outer shroud 40, for example, and is used to cool the stator blades 42.

Further, a part of the cooling medium led to the space 36 passes through the gland sealing part 33*b* to flow into the space 56. The pressure of the cooling medium flowing into the space 56 is lower than that of the cooling medium in the space 36.

A part of the cooling medium led to the space 56 flows into the introduction passage 90 from the inlet 90*a*. The cooling medium that has flowed into the introduction passage 90 functions as the low-pressure cooling medium.

The low-pressure cooling medium that has flowed into the introduction passage 90 flows into the axial passage 91 through the introduction passage 90. The flow rate of the cooling medium to be led to the axial passage 91 is adjusted by a bore or the like of the introduction passage 90, for example.

The low-pressure cooling medium led to the axial passage 91 flows toward the downstream side in the axial direction through the axial passage 91. The low-pressure cooling medium flowing toward the downstream side in the axial direction through the axial passage 91 flows into the respective discharge passages 92 formed to correspond to the low-pressure side turbine stages.

The low-pressure cooling medium that has flowed into the discharge passage 92 flows through the discharge passage 92 to be ejected from the outlet 92*a* into the space 45 in the low-pressure side turbine stage. The flow rate of the low-pressure cooling medium led to each of the discharge passages 92 is adjusted by a bore or the like of each of the discharge passages 92, for example.

Here, the rotor body portion 11 (the turbine rotor 10A) is cooled from the inside by the low-pressure cooling medium flowing through the introduction passage 90, the axial passage 91, and the discharge passages 92.

The low-pressure cooling medium that has spread in the space 45 flows into the working fluid flow path 55 through the gap between the heat shield piece 43 and the turbine disk 12 and the gap between the inner shroud 41 and the turbine disk 12. The low-pressure cooling medium that has flowed into the working fluid flow path 55 flows through the working fluid flow path 55 with the working fluid to be discharged into the exhaust hood 75.

Here, the outer peripheral surface 11*a* of the rotor body portion 11 facing the space 45 and the turbine disk 12 are cooled by the low-pressure cooling medium flowing into the space 45 and the low-pressure cooling medium flowing out into the working fluid flow path 55.

The difference (or pressure ratio) between the pressure of the low-pressure cooling medium ejected from the discharge passage 92 into the space 45, namely, the low-pressure side turbine stage, and the pressure of the working fluid in the low-pressure side turbine stage is smaller than the differential pressure (or pressure ratio) that produces a choked flow of the low-pressure cooling medium.

The turbine rotor 10A in the above-described first embodiment includes the high-pressure cooling passage 13A and the low-pressure cooling passage 13B into which the cooling mediums having different pressures are to be introduced. Then, the high-pressure cooling medium introduced into the high-pressure cooling passage 13A is introduced into the high-pressure side turbine stages. The low-pressure cooling medium introduced into the low-pressure cooling passage 13B is introduced into the low-pressure side turbine stages.

As above, according to the turbine stage, the high-pressure cooling medium is allowed to be introduced into the turbine stage where the high-pressure working fluid flows. Further, the low-pressure cooling medium is allowed to be introduced into the turbine stage where the low-pressure working fluid flows.

This makes it possible to introduce the cooling medium into the respective turbine stages at an appropriate pressure even in a turbine with a high pressure ratio. Therefore, even in the low-pressure side turbine stages, the flow of the cooling medium will not be choked and the cooling medium with an optimum flow rate is allowed to be introduced into the respective turbine stages.

Further, the high-pressure supercritical cooling medium is introduced into the space 36. Therefore, the flow rate of the cooling medium leaking from the gland sealing part 33*b* increases. However, in the turbine rotor 10A in the first embodiment, the cooling medium that has leaked from the gland sealing part 33*b* can be used as the cooling medium to be introduced into the low-pressure cooling passage 13B. This reduces the flow rate of the cooling medium to leak to the outside from the high-pressure side gland sealing part 33*a*.

Another Mode of the First Embodiment

Figure 4:
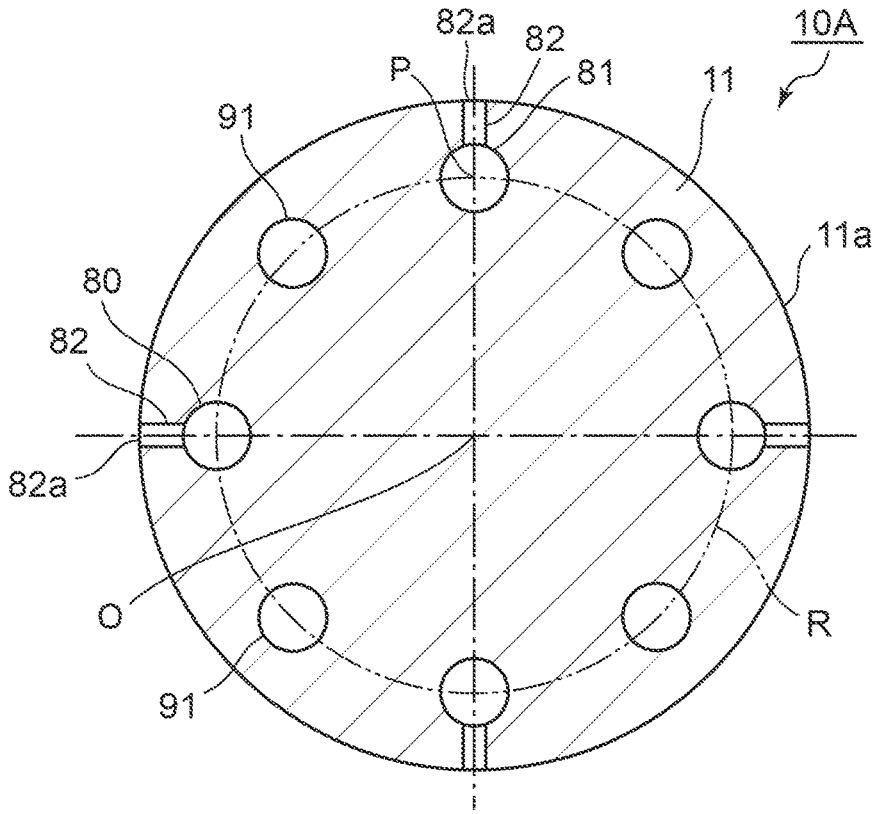
FIG. 4 is a view illustrating a cross section of a turbine rotor in another mode of the first embodiment, which is equivalent to the cross section taken along A-A in FIG.
Figure 5:
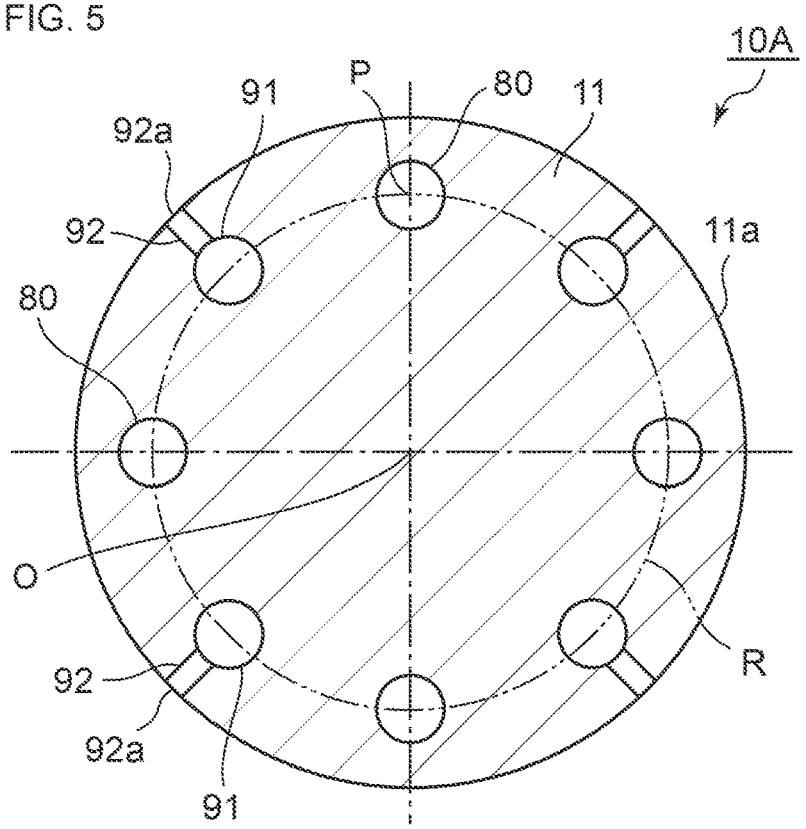
FIG. 5 is a view illustrating a cross section of the turbine rotor in the another mode of the first embodiment, which is equivalent to the cross section taken along B-B in FIG. 1.

FIG. 4 is a view illustrating a cross section of a turbine rotor 10A in another mode of the first embodiment, which is equivalent to the cross section taken along A-A in FIG. 1. FIG. 5 is a view illustrating a cross section of the turbine rotor 10A in the another mode of the first embodiment, which is equivalent to the cross section taken along B-B in FIG. 1. FIG. 4 and FIG. 5 each illustrate a cross section vertical to the center axis O of the turbine rotor 10A.

In the turbine rotor 10A in this mode, another example of the configuration of the axial passage 91 in the low-pressure cooling passage 13B is explained.

As illustrated in FIG. 4 and FIG. 5, a plurality of the axial passages 91 may be formed. Specifically, the axial passage 91 may be formed in the axial direction in the rotor body portion 11, on the radially outer side relative to the center axis O of the turbine rotor 10A and on the radially inner side relative to the outer peripheral surface 11*a* of the rotor body portion 11. That is, the axial passage 91 is formed between the center axis O and the outer peripheral surface 11*a* of the rotor body portion 11.

Here, the axial passages 91 are evenly arranged on the same circumference R where the axial passages 81 of the high-pressure cooling passage 13A are formed in a manner to be displaced in the circumferential direction with respect to the axial passages 81. Further, in this case, the axial passages 81 and the axial passages 91 are evenly arranged on the same circumference R.

The arrangement configuration of the axial passages 91 is not limited to this configuration. For example, the axial passages 91 may be evenly arranged on the same circumference around the center axis O, which is different from the circumference R.

As above, even in the turbine rotor 10A including a plurality of the axial passages 91 in the low-pressure cooling passage 13B, the same action and effect as those in the turbine rotor 10A in the above-described first embodiment can be obtained.

Further, in the turbine rotor 10A including a plurality of the axial passages 81 and 91 evenly arranged on the same circumference, which is arbitrary, around the center axis O, the tangential stress (shear stress) generated in an inner wall portion of the axial passage can be reduced as compared to the turbine rotor including the axial passage centered on the center axis O.

Further, a plurality of the axial passages 81, 91 are evenly arranged on the same circumference, which is arbitrary, around the center axis O, thereby making it possible to ensure rotor-shaft system stability when the turbine rotor 10A rotates.

Figure 6:
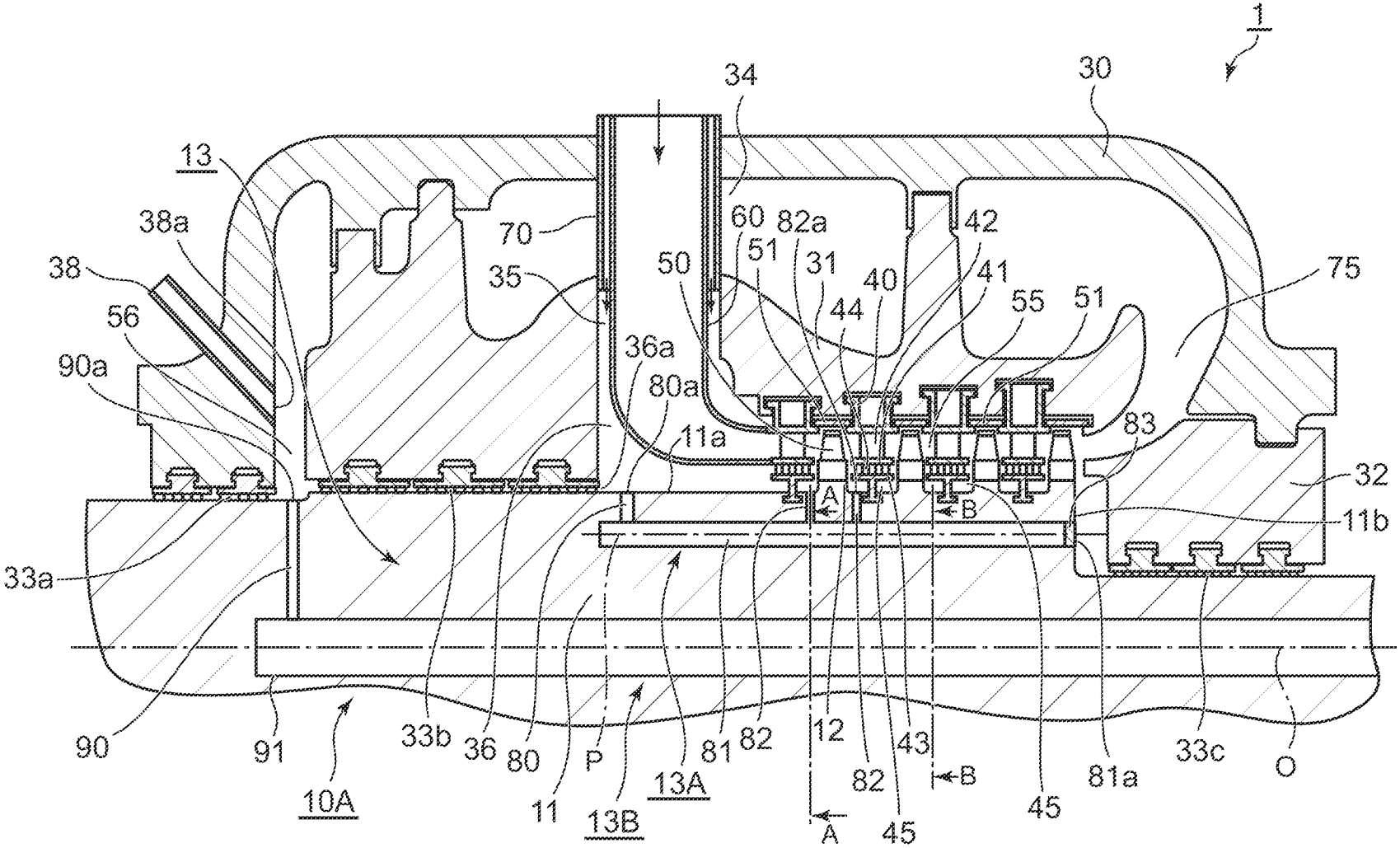
FIG. 6 is a view illustrating a meridian cross section of an axial flow turbine with another configuration including the turbine rotor in the first embodiment.

Here, the above-described configuration of the axial flow turbine is not limited to this configuration. FIG. 6 is a view illustrating a meridian cross section of the axial flow turbine 1 in another configuration, which includes the turbine rotor 10A in the first embodiment.

As illustrated in FIG. 6, the axial flow turbine 1 may include a cooling medium introduction pipe 38 that penetrates the outer casing 30 and introduces a cooling medium from the outside of the axial flow turbine 1 into the space 56 formed at the high-pressure side gland sealing part. An outlet 38*a* of the cooling medium introduction pipe 38 opens in the space 56.

The pressure of the cooling medium to flow into the space 56 from the cooling medium introduction pipe 38 is set to be substantially the same as the pressure of the low-pressure cooling medium to flow into the space 56 through the gland sealing part 33*b*. The pressure of the cooling medium to be introduced into the cooling medium introduction pipe 38 is lower than that of the high-pressure cooling medium.

As the cooling medium to be introduced into the cooling medium introduction pipe 38, for example, a working fluid extracted from a part of the system of a supercritical $CO_2$ gas turbine facility including the axial flow turbine 1 or the like can be used. Further, for example, a working fluid extracted from a part of the system of a different supercritical $CO_2$ gas turbine facility installed with the supercritical $CO_2$ gas turbine facility including the axial flow turbine 1, or the like can be used.

A supply source of the cooling medium to be introduced into the cooling medium introduction pipe 38 is not limited to these, but may be any supply source whose conditions, such as pressure and temperature, are suitable for the cooling medium to be introduced into the space 56.

Here, since the space 56 communicates with the introduction passage 90, the cooling medium introduced into the space 56 from the cooling medium introduction pipe 38 flows into the introduction passage 90 with the low-pressure cooling medium that has flowed into the space 56 through the gland sealing part 33*b*.

By introducing the cooling medium into the space 56 from the outside of the axial flow turbine 1 through the cooling medium introduction pipe 38 in this manner, the flow rate of the cooling medium to flow into the introduction passage 90 increases. Therefore, the flow rate of the cooling medium to be ejected from the discharge passage 92 into the space 45 increases. This can promote cooling of the outer peripheral surface 11*a* of the rotor body portion 11, the turbine disk 12, and the like.

Here, the cooling medium introduction pipe 38 is provided with a not-illustrated flow rate regulating valve, and thereby, it is possible to introduce the cooling medium into the space 56 as necessary, for example. At the time of start-up of the supercritical $CO_2$ gas turbine facility, for example, the temperature of the working fluid sometimes rises above a set temperature. In such a case, the cooling medium can be introduced into the space 56 through the cooling medium introduction pipe 38.

Second Embodiment

Figure 7:
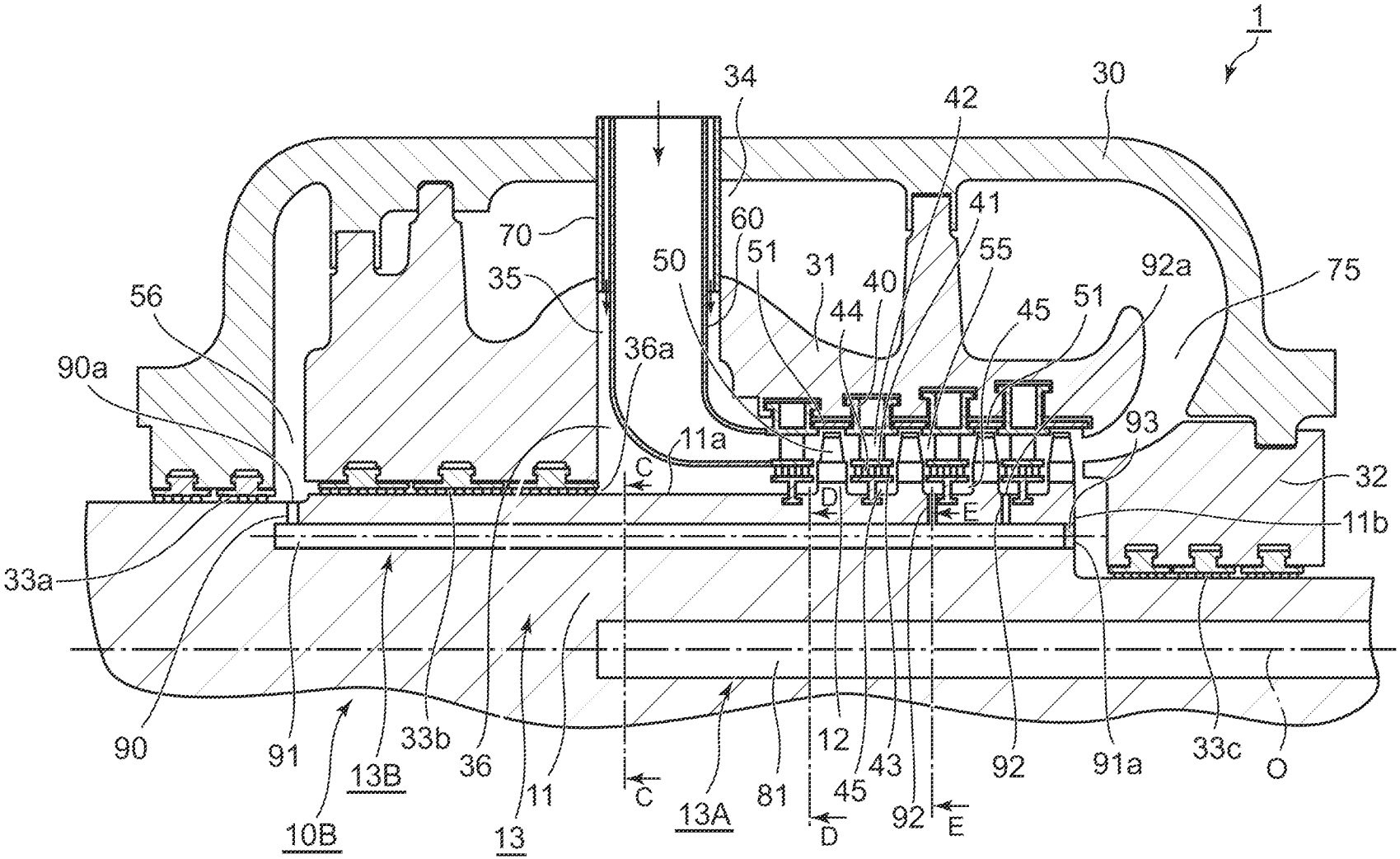
FIG. 7 is a view illustrating a meridian cross section of an axial flow turbine including a turbine rotor in a second embodiment.
Figure 8:
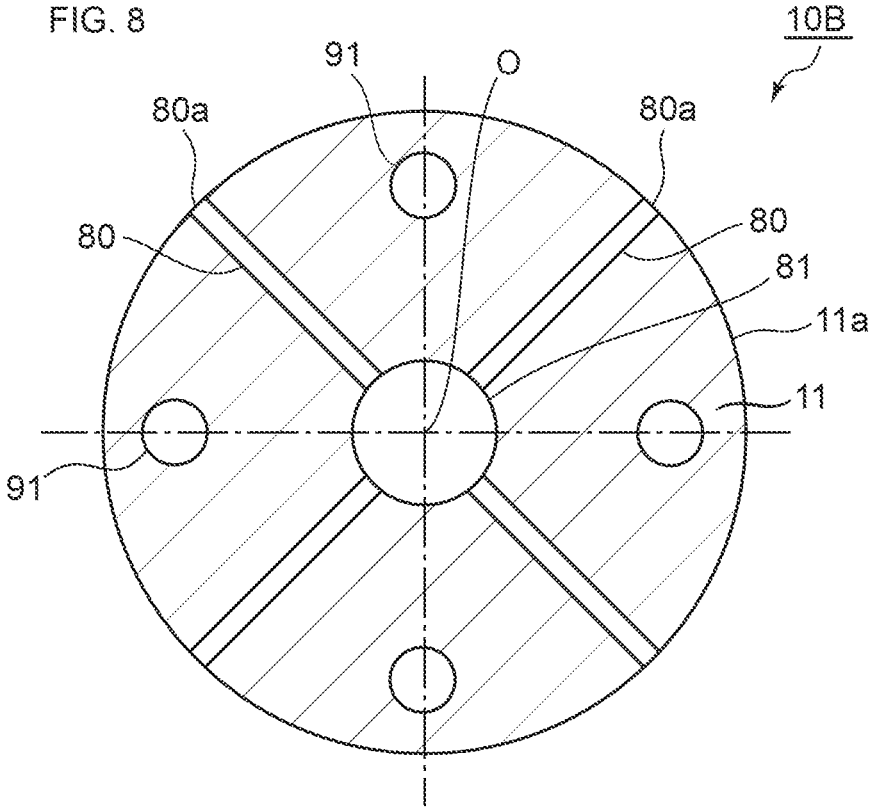
FIG. 8 is a view illustrating a cross section taken along C-C in FIG. 7.
Figure 9:
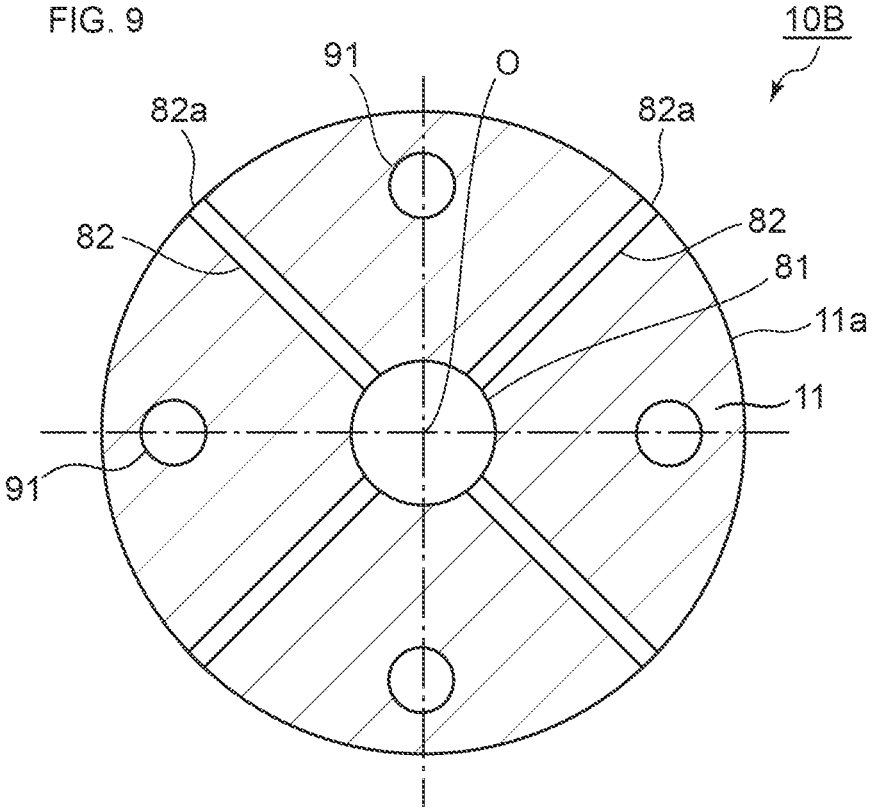
FIG. 9 is a view illustrating a cross section taken along D-D in FIG. 7.
Figure 10:
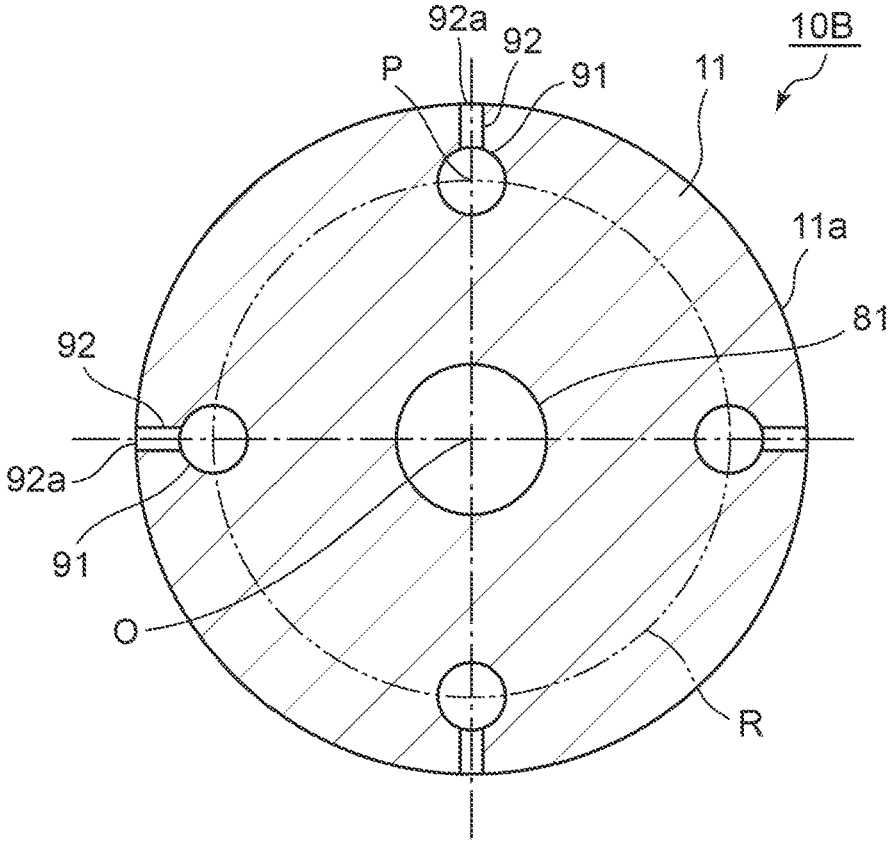
FIG. 10 is a view illustrating a cross section taken along E-E in FIG. 7.

FIG. 7 is a view illustrating a meridian cross section of an axial flow turbine 1 including a turbine rotor 10B in a second embodiment. FIG. 8 is a view illustrating a cross section taken along C-C in FIG. 7. FIG. 9 is a view illustrating a cross section taken along D-D in FIG. 7. FIG. 10 is a view illustrating a cross section taken along E-E in FIG. 7. FIG. 8, FIG. 9, and FIG. 10 each illustrate a cross section vertical to a center axis O of the turbine rotor 10B.

In the following embodiment, the same reference numerals and symbols are added to the same component parts as those of the turbine rotor 10A in the first embodiment and the axial flow turbine 1 including the turbine rotor 10A, and redundant explanations are omitted or simplified.

In the turbine rotor 10B in the second embodiment, the high-pressure cooling passage 13A and the low-pressure cooling passage 13B in the turbine rotor 10A in the first embodiment are switched in terms of the arrangement configuration. That is, the configuration of the turbine rotor 10B in the second embodiment is the same as that of the turbine rotor 10A in the first embodiment except for the configuration of the cooling structure part 13. For this reason, the configuration of the cooling structure part 13 will be mainly explained here.

The cooling structure part 13 is formed in a rotor body portion 11 in the turbine rotor 10B. The cooling structure part 13 includes a high-pressure cooling passage 13A and a low-pressure cooling passage 13B.

First, the high-pressure cooling passage 13A is explained.

A high-pressure cooling medium introduced into a space 36 from a cooling medium supply pipe 70 is introduced into the high-pressure cooling passage 13A.

As illustrated in FIG. 7 to FIG. 9, the high-pressure cooling passage 13A includes introduction passages 80, an axial passage 81, and discharge passages 82.

In the cross section illustrated in FIG. 7, the introduction passages 80 and the discharge passages 82 are not seen. That is, as illustrated in FIG. 8 and FIG. 9, the introduction passage 80 and the discharge passage 82 are arranged at positions displaced in the circumferential direction around the center axis O with respect to an introduction passage 90 and a discharge passage 92 illustrated in FIG. 7.

As illustrated in FIG. 8, the introduction passage 80 is formed of a through hole penetrating from an outer peripheral surface 11*a* of the rotor body portion 11 into the axial passage 81, for example. An inlet 80*a* of the introduction passage 80 opens in the space 36 inside an inner casing 31 into which a high-pressure cooling medium is to be introduced. The configuration of the introduction passage 80 is as explained in the first embodiment.

As illustrated in FIG. 7 to FIG. 9, the axial passage 81 is extended in the axial direction with the center axis O of the turbine rotor 10B set as the center axis. The axial passage 81 is formed of, for example, a hole with a circular cross section.

Further, as illustrated in FIG. 7, the axial passage 81 is formed, for example, from the position in the axial direction where the introduction passage 80 is formed to the position in the axial direction corresponding to at least the high-pressure side turbine stage.

FIG. 7 illustrates one example where the axial passage 81 penetrates from the position in the axial direction where the introduction passage 80 is formed to the low-pressure side. In this case, an outlet of the axial passage 81 is sealed by a sealing member (not illustrated). Further, the axial passage 81 only needs to be formed within a range where the high-pressure cooling medium is introduced from the introduction passage 80 and the cooling medium is led to the respective discharge passages 82.

The discharge passages 82 are formed in a manner to correspond to the high-pressure side turbine stages. Here, the discharge passages 82 are formed at the positions in the axial direction corresponding to the first turbine stage and the second turbine stage.

As illustrated in FIG. 9, the discharge passage 82 is formed of a through hole penetrating from the axial passage 81 into the outer peripheral surface 11*a* of the rotor body portion 11. The discharge passage 82 has an outlet 82*a* in the outer peripheral surface 11*a* of the rotor body portion 11. The discharge passage 82 communicates the axial passage 81 with a space 45.

Next, the low-pressure cooling passage 13B is explained.

A low-pressure cooling medium that has flowed into a space 56 at a high-pressure side gland sealing part is introduced into the low-pressure cooling passage 13B.

As illustrated in FIG. 7 and FIG. 10, the low-pressure cooling passage 13B includes the introduction passages 90, axial passages 91, and the discharge passages 92.

The introduction passage 90 is formed of a through hole penetrating from the outer peripheral surface 11*a* of the rotor body portion 11 into the axial passage 91, for example. An inlet 90*a* of the introduction passage 90 opens in the space 56 at the high-pressure side gland sealing part. The configuration of the introduction passage 90 is as explained in the first embodiment.

As illustrated in FIG. 7 and FIG. 10, the axial passage 91 is formed in the axial direction in the rotor body portion 11, on the radially outer side relative to the center axis O of the turbine rotor 10B and on the radially inner side relative to the outer peripheral surface 11*a* of the rotor body portion 11. That is, the axial passage 91 is formed between the center axis O and the outer peripheral surface 11*a* of the rotor body portion 11. The axial passage 91 is formed of, for example, a hole with a circular cross section.

The arrangement configuration in the circumferential direction when a plurality of the axial passages 91 are included is the same as that of the axial passages 81 in the first embodiment.

The axial passage 91 is formed, for example, from the position in the axial direction where the introduction passage 90 is formed to the position in the axial direction corresponding to the outlet of the final turbine stage. Here, the axial passage 91 penetrates a downstream end 11*b* where the diameter of the turbine rotor is small, which faces a packing head 32. In this case, an outlet 91*a* of the axial passage 91 is sealed by a sealing member 93.

The axial passage 91 only needs to be formed within a range where the low-pressure cooling medium is introduced from the introduction passage 90 and the cooling medium is led to the respective discharge passages 92.

The discharge passages 92 are formed in a manner to correspond to the low-pressure side turbine stages as illustrated in FIG. 7 and FIG. 10. Here, the discharge passages 92 are formed at the positions in the axial direction corresponding to the third turbine stage and the fourth turbine stage.

The discharge passage 92 is formed of a through hole penetrating from the axial passage 91 into the outer peripheral surface 11*a* of the rotor body portion 11. The discharge passage 92 has an outlet 92*a* in the outer peripheral surface 11*a* of the rotor body portion 11. The discharge passage 92 communicates the axial passage 91 with the space 45.

Then, the action of the cooling medium led to the space 36 as the high-pressure cooling medium, and the action of the cooling medium led to the space 56 as the low-pressure cooling medium are as explained in the first embodiment.

The turbine rotor 10B in the above-described second embodiment includes the high-pressure cooling passage 13A and the low-pressure cooling passage 13B into which the cooling mediums with different pressures are to be introduced. The effect obtained by including the high-pressure cooling passage 13A and the low-pressure cooling passage 13B is as explained in the first embodiment.

Another Mode of the Second Embodiment

Figure 11:
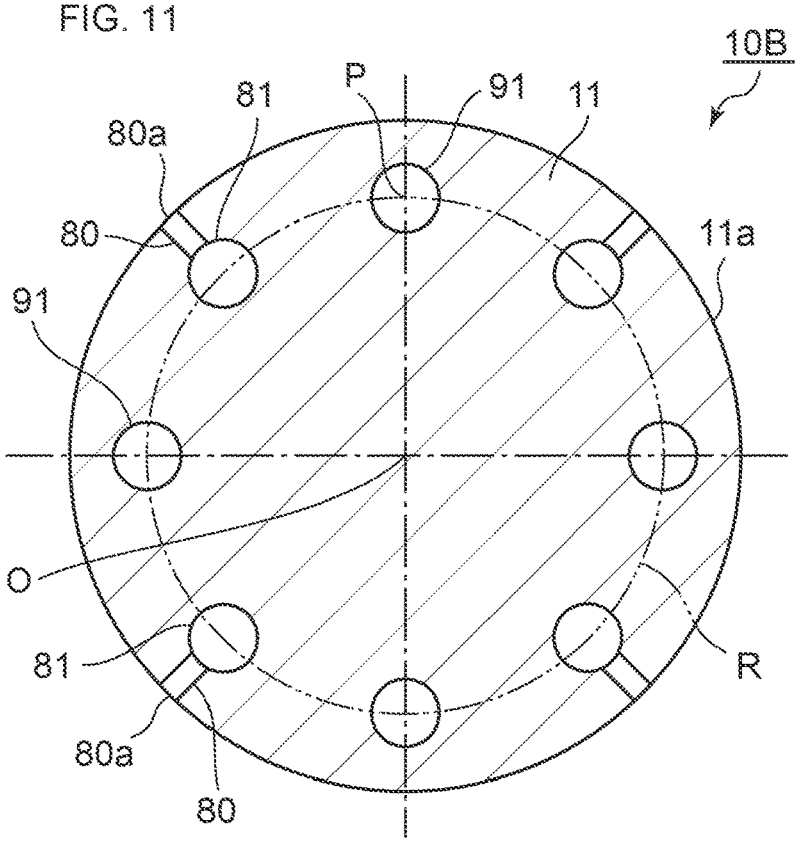
FIG. 11 is a view illustrating a cross section of a turbine rotor in another mode of the second embodiment, which is equivalent to the cross section taken along C-C in FIG. 7.
Figure 12:
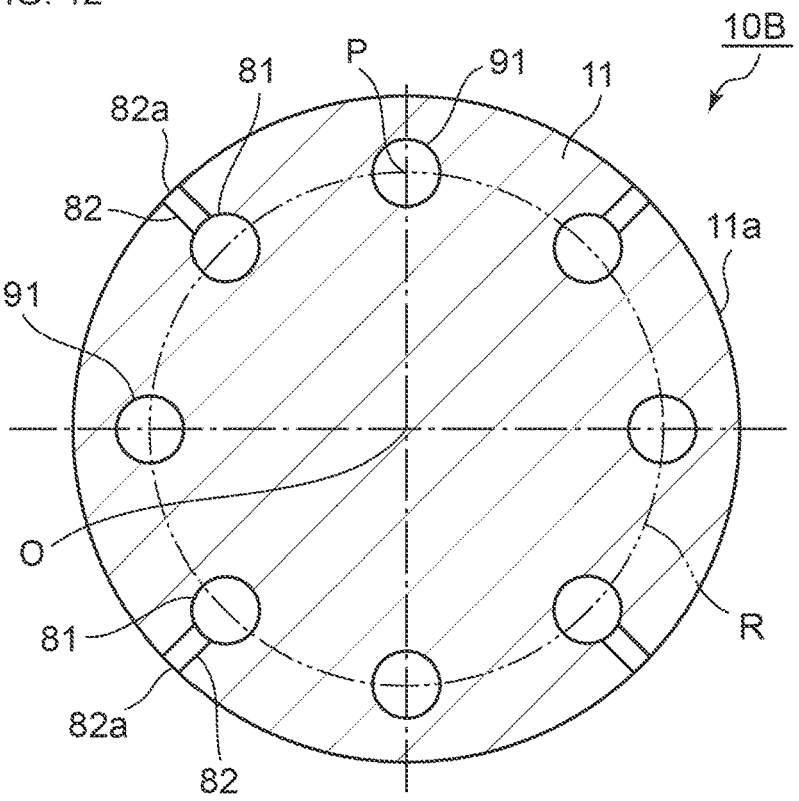
FIG. 12 is a view illustrating a cross section of the turbine rotor in the another mode of the second embodiment, which is equivalent to the cross section taken along D-D in FIG. 7.
Figure 13:
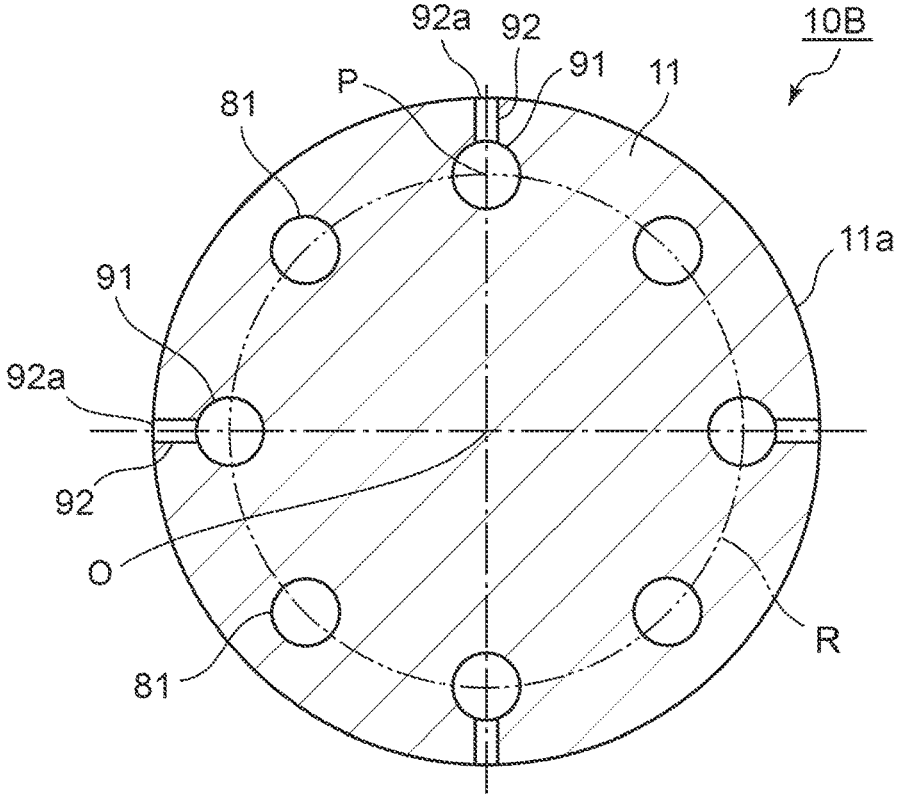
FIG. 13 is a view illustrating a cross section of the turbine rotor in the another mode of the second embodiment, which is equivalent to the cross section taken along E-E in FIG. 7.
Figure 14:
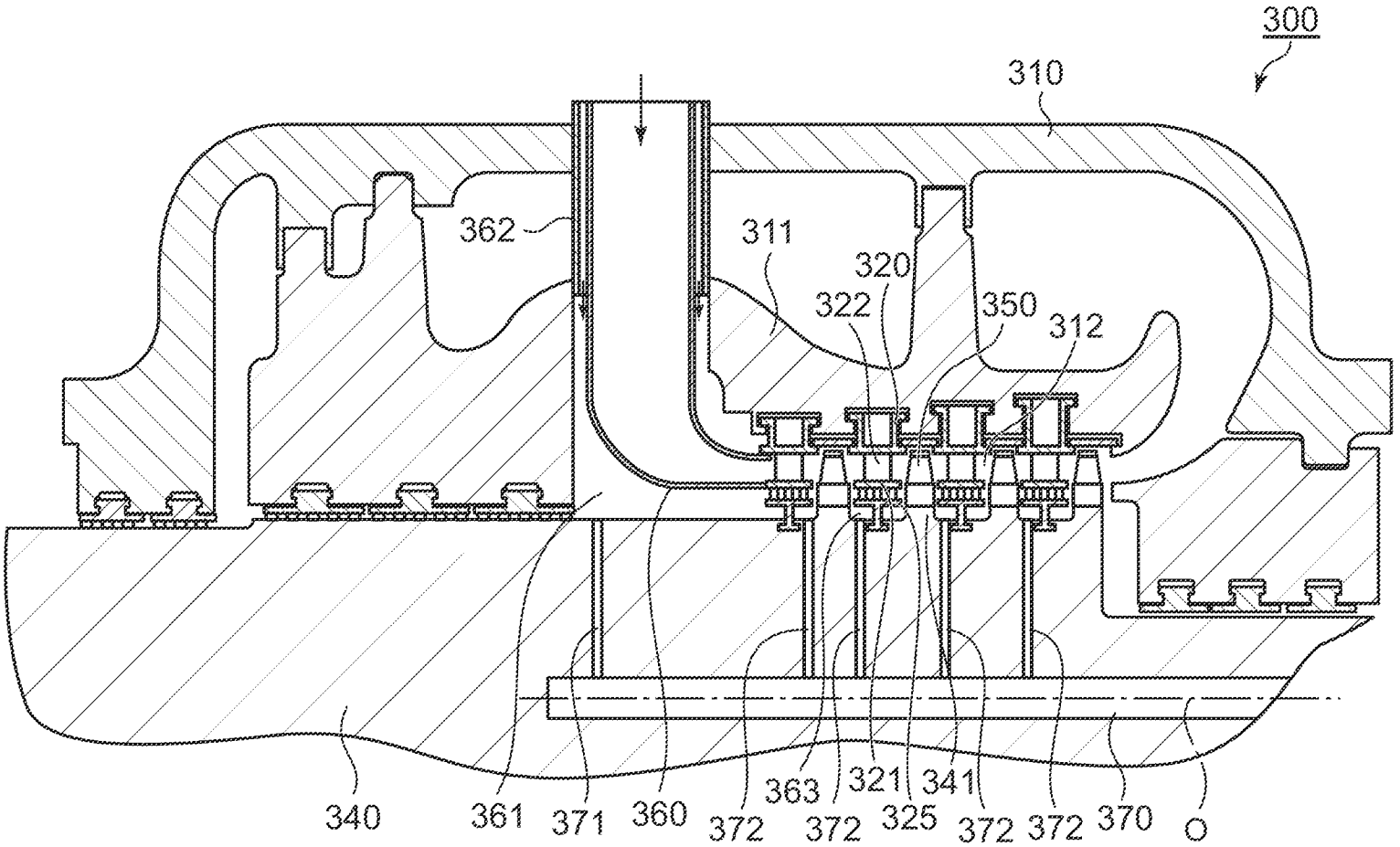
FIG. 14 is a view illustrating a meridian cross section of a conventional axial flow turbine.

FIG. 11 is a view illustrating a cross section of a turbine rotor 10B in another mode of the second embodiment, which is equivalent to the cross section taken along C-C in FIG. 7. FIG. 12 is a view illustrating a cross section of the turbine rotor 10B in the another mode of the second embodiment, which is equivalent to the cross section taken along D-D in FIG. 7. FIG. 13 is a view illustrating a cross section of the turbine rotor 10B in the another mode of the second embodiment, which is equivalent to the cross section taken along E-E in FIG. 7. FIG. 11 to FIG. 13 each illustrate a cross section vertical to the center axis O of the turbine rotor 10B.

In the turbine rotor 10B in this mode, another example of the configuration of the axial passage 81 in the high-pressure cooling passage 13A is explained.

As illustrated in FIG. 11, FIG. 12, and FIG. 13, a plurality of the axial passages 81 may be formed. Specifically, the axial passage 81 may be formed in the axial direction in the rotor body portion 11, on the radially outer side relative to the center axis O of the turbine rotor 10B and on the radially inner side relative to the outer peripheral surface 11*a* of the rotor body portion 11. That is, the axial passage 81 is formed between the center axis O and the outer peripheral surface 11*a* of the rotor body portion 11.

Here, the axial passages 81 are evenly arranged on the same circumference R where the axial passages 91 of the low-pressure cooling passage 13B are formed in a manner to be displaced in the circumferential direction with respect to the axial passages 91. Further, in this case, the axial passages 81 and the axial passages 91 are evenly arranged on the same circumference R.

The arrangement configuration of the axial passages 81 is not limited to this configuration. For example, the axial passages 81 may be evenly arranged on the same circumference around the center axis O, which is different from the circumference R.

As above, even in the turbine rotor 10B including a plurality of the axial passages 81 in the high-pressure cooling passage 13A, the same action and effect as those in the turbine rotor 10B in the above-described second embodiment can be obtained.

Further, in the turbine rotor 10B including a plurality of the axial passages 81 and 91 evenly arranged on the same circumference, which is arbitrary, around the center axis O, the tangential stress (shear stress) generated in an inner wall portion of the axial passage can be reduced as compared to the turbine rotor including the axial passage centered on the center axis O.

Further, a plurality of the axial passages 81, 91 are evenly arranged on the same circumference, which is arbitrary, around the center axis O, thereby making it possible to ensure rotor-shaft system stability when the turbine rotor 10B rotates.

Here, even the axial flow turbine 1 including the turbine rotor 10B in the second embodiment may include the cooling medium introduction pipe 38 that penetrates the outer casing 30 and introduces a cooling medium from the outside of the axial flow turbine 1 into the space 56 formed at the high-pressure side gland sealing part as illustrated in FIG. 6. The action and effect obtained by including the cooling medium introduction pipe 38 are as explained previously.

The embodiments explained above make it possible to supply the cooling medium that has cooled the turbine rotor to the respective turbine stages at a proper pressure.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A turbine rotor, comprising:

a column-shaped rotor body portion;

a plurality of turbine disks projecting to a radially outer side from an outer peripheral surface of the rotor body portion over a circumferential direction and provided in a center axis direction of the rotor body portion to form a plurality of turbine stages;

a first cooling passage portion formed in the rotor body portion, the first cooling passage portion to which a first cooling medium is supplied, and the first cooling passage portion that discharges the first cooling medium to a high-pressure side turbine stage, which is a high-pressure side out of the turbine stages; and a second cooling passage portion formed in the rotor body portion, the second cooling passage portion to which a second cooling medium whose pressure is lower than pressure of the first cooling medium is supplied, and the second cooling passage portion that discharges the second cooling medium to a low-pressure side turbine stage, which is a side lower in pressure than the high-pressure side turbine stage;

wherein the first cooling passage portion includes:

a first axial passage formed in the center axis direction of the turbine rotor;

a first introduction passage that introduces the first cooling medium into the first axial passage; and a first discharge passage that discharges the first cooling medium to the high-pressure side turbine stage from the first axial passage, and the second cooling passage portion includes:

a second axial passage formed in the center axis direction of the turbine rotor;

a second introduction passage that introduces the second cooling medium into the second axial passage; and a second discharge passage that discharges the second cooling medium to the low-pressure side turbine stage from the second axial passage.

2. The turbine rotor according to claim 1, wherein the first axial passage is formed, in the rotor body portion, on a radially outer side relative to a center axis of the turbine rotor and on a radially inner side relative to an outer peripheral surface of the rotor body portion, and the second axial passage is formed in the center axis direction of the turbine rotor with the center axis of the turbine rotor set as a center axis.

3. The turbine rotor according to claim 1, wherein the first axial passage is formed in the center axis direction of the turbine rotor with a center axis of the turbine rotor set as a center axis, and the second axial passage is formed, in the rotor body portion, on a radially outer side relative to the center axis of the turbine rotor and on a radially inner side relative to an outer peripheral surface of the rotor body portion.

4. The turbine rotor according to claim 1, wherein the first axial passage and the second axial passage are formed, in the rotor body portion, on a radially outer side relative to a center axis of the turbine rotor and on a radially inner side relative to an outer peripheral surface of the rotor body portion.

5. The turbine rotor according to claim 1, wherein the second introduction passage is formed to be able to communicate with a gland sealing part provided between the turbine rotor and a turbine casing or with a space formed at the gland sealing part.

6. The turbine rotor according to claim 2, wherein the second introduction passage is formed to be able to communicate with a gland sealing part provided between the turbine rotor and a turbine casing or with a space formed at the gland sealing part.

7. The turbine rotor according to claim 3, wherein the second introduction passage is formed to be able to communicate with a gland sealing part provided between the turbine rotor and a turbine casing or with a space formed at the gland sealing part.

8. The turbine rotor according to claim 4, wherein the second introduction passage is formed to be able to communicate with a gland sealing part provided between the turbine rotor and a turbine casing or with a space formed at the gland sealing part.

9. An axial flow turbine, including:

a casing;

a turbine rotor penetrating the casing; and a gland sealing part provided between the casing and the turbine rotor, in which the turbine rotor includes:

a column-shaped rotor body portion;

a plurality of turbine disks projecting to a radially outer side from an outer peripheral surface of the rotor body portion over a circumferential direction and provided in a center axis direction of the rotor body portion to form a plurality of turbine stages;

a first cooling passage portion formed in the rotor body portion, the first cooling passage portion to which a first cooling medium is supplied, and the first cooling passage portion that discharges the first cooling medium to a high-pressure side turbine stage, which is a high-pressure side out of the turbine stages; and a second cooling passage portion formed in the rotor body portion, the second cooling passage portion to which a second cooling medium whose pressure is lower than pressure of the first cooling medium is supplied, and the second cooling passage portion that discharges the second cooling medium to a low-pressure side turbine stage, which is a side lower in pressure than the high-pressure side turbine stage, the first cooling passage portion includes:

a first axial passage formed in the center axis direction of the turbine rotor;

a first introduction passage that introduces the first cooling medium into the first axial passage; and a first discharge passage that discharges the first cooling medium to the high-pressure side turbine stage from the first axial passage, and the second cooling passage portion includes:

a second axial passage formed in the center axis direction of the turbine rotor;

a second introduction passage that introduces the second cooling medium into the second axial passage; and a second discharge passage that discharges the second cooling medium to the low-pressure side turbine stage from the second axial passage, the axial flow turbine comprising:

a cooling medium introduction pipe penetrating the casing and formed at the gland sealing part, the cooling medium introduction pipe that introduces a cooling medium into a space communicating with the second introduction passage from the outside.

* * * * *